United States Patent [19]

Canipe

[11] Patent Number: 4,968,972

[45] Date of Patent: Nov. 6, 1990

[54] CONVERSION OF BIAS STRIP IN A FREQUENCY-DIVIDING-TRANSPONDER TAG INTO A TRIPOLE BAR MAGNET TO DEACTIVATE THE TAG

[75] Inventor: Larry K. Canipe, Palm Harbor, Fla.

[73] Assignee: Security Tag Systems, Inc., St. Petersburg, Fla.

[21] Appl. No.: 374,961

[22] Filed: Jun. 30, 1989

[51] Int. Cl.[5] ..... G08B 13/24

[52] U.S. Cl. ..... 340/551; 335/219; 335/284; 335/302; 340/572

[58] Field of Search ..... 340/551, 572; 335/284, 335/306, 302, 219

[56] References Cited

U.S. PATENT DOCUMENTS

| | | | |
|---|---|---|---|
| 3,781,661 | 12/1973 | Trikilis | 340/572 |
| 4,158,434 | 6/1979 | Peterson | 235/382 |
| 4,727,360 | 2/1988 | Ferguson et al. | 340/572 |

*Primary Examiner*—Glen R. Swann, III

*Attorney, Agent, or Firm*—Edward W. Callan

[57] ABSTRACT

A method of deactivating a frequency-dividing-transponder that includes an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; and a magnetized bias strip of magnetic material having first and second ends and disposed in relation to the active strip of magnetic material for magnetically biasing the active strip of magnetic material to be within the predetermined magnetic field intensity range only when the bias strip of magnetic material is magnetized includes the step of converting the bias strip of magnetic material into a tripole bar magnet, having a pole of one magnetic polarity in a predetermined region of the strip located between the ends of the strip, and having a pole of a different magnetic polarity than the one magnetic polarity at each end of the bias strip to thereby provide opposing magnetic bias fields in opposite longitudinal halves of the active strip for causing any electromagnetic radiation of the second predetermined frequency that is generated in one half of the active strip to be of equal and opposite polarity and thus cancelled by any electromagnetic radiation of the second predetermined frequency that is generated in the other half of the active strip. This is accomplished by laterally passing a magnet across and in close proximity to the bias strip of magnetic material, with the magnet having sufficient flux density to overcome the magnetic bias of the bias strip, and with the magnet being passed across the predetermined region of the bias strip.

12 Claims, 1 Drawing Sheet

FIG. 1
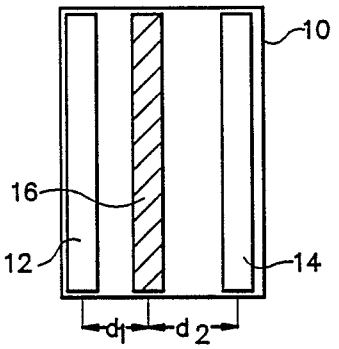
FIG. 2A
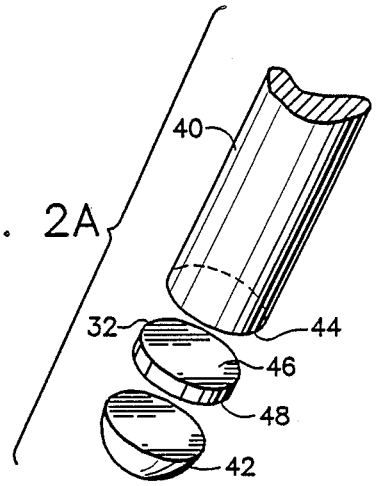
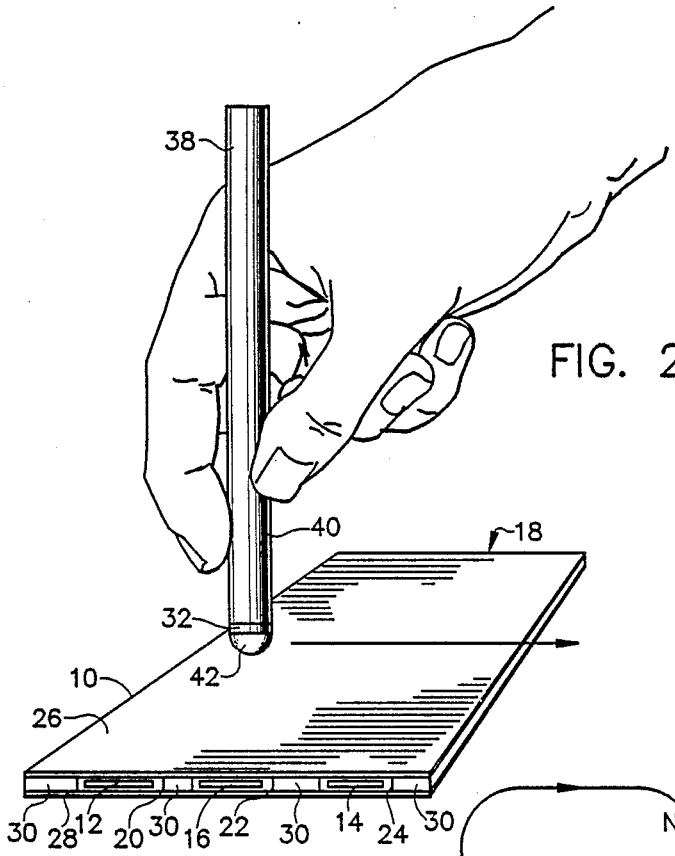
FIG. 2
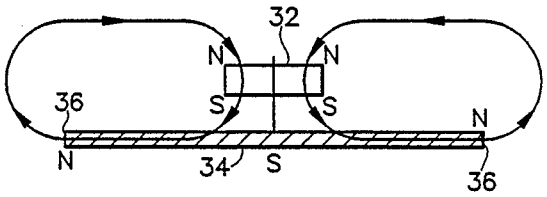
FIG. 3

CONVERSION OF BIAS STRIP IN A FREQUENCY-DIVIDING-TRANSPONDER TAG INTO A TRIPOLE BAR MAGNET TO DEACTIVATE THE TAG

BACKGROUND OF THE INVENTION

The present invention generally pertains to presence-detection-system tags that include frequency-dividing transponders and is particularly directed to deactivation of frequency-dividing transponders of the type that includes an active strip of magnetomechanical material that frequency divides when in the presence of a magnetic field within a predetermined magnetic field intensity range and a bias strip of magnetic material for biasing the active strip to be within the predetermined range.

This type of frequency-dividing-transponder is described in U.S. Pat. No. 4,727,360 to Lucian G. Ferguson and Lincoln H. Charlot, Jr., which is assigned to the assignee of the present application. According to the teaching of said patent, the frequency-dividing transponder described therein is deactivated by demagnetizing the bias strip of magnetic material. However, even after the bias strip has been demagnetized, the active strip of magnetomechanical material will still frequency divide if it is in the presence of an ambient magnetic field that is within the predetermined magnetic field intensity range. In certain locations, the ambient magnetic field resulting from the Earth's magnetic field is within the predetermined magnetic field intensity range. Presence-detection-system tags containing the above-described type of frequency-dividing transponder are adapted for attachment to articles to be detected within a surveillance zone. If the ambient magnetic field within the surveillance zone is within the predetermined magnetic field intensity range, false presence detections may occur even after the bias strip has been demagnetized.

SUMMARY OF THE INVENTION

The present invention provides a method of deactivating a frequency-dividing transponder that includes an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; and a magnetized bias strip of magnetic material having first and second ends and disposed in relation to the active strip of magnetic material for magnetically biasing the active strip of magnetic material to be within the predetermined magnetic field intensity range only when the bias strip of magnetic material is magnetized. The method includes the step of (a) converting the bias strip of magnetic material into a tripole bar magnet, having a pole of one magnetic polarity in a predetermined region of the strip located between the ends of the strip, and having a pole of a different magnetic polarity than said one magnetic polarity at each end of the bias strip to thereby provide opposing magnetic bias fields in opposite longitudinal halves of the active strip for causing any electromagnetic radiation of said second predetermined frequency that is generated in one half of the active strip to be of equal and opposite polarity and thus cancelled by any electromagnetic radiation of said second predetermined frequency that is generated in the other half of the active strip.

Preferably, step (a) is accomplished by the step of (b) laterally passing a magnet across and in close proximity to the bias strip of magnetic material, with the magnet having sufficient flux density to overcome the magnetic bias of the bias strip, and with the magnet being passed across said predetermined region of the bias strip.

Upon accomplishing the above-described conversion of the bias strip, the present invention provides a tag comprising a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; and a tripole bar magnet, comprising a bar of magnetic material having a first end and a second end, the bar having a pole of one magnetic polarity in a predetermined region of the bar located between the ends of the bar, and having a pole of a different magnetic polarity than said one magnetic polarity at each end of the bar; wherein the bar magnet is disposed in relation to the active strip of magnetic material for providing opposing magnetic bias fields in opposite longitudinal halves of the active strip for causing any electromagnetic radiation of said second predetermined frequency that is generated in one half of the active strip to be of equal and opposite polarity and thus cancelled by any electromagnetic radiation of said second predetermined frequency that is generated in the other half of the active strip.

In another aspect, the present invention provides a tripole bar magnet, comprising a bar of magnetic material having a first end and a second end, the bar having only one pole of one magnetic polarity located between the ends of the bar, and having a pole of a different magnetic polarity than said one magnetic polarity at each end of the bar.

The present invention also provides a process of forming a tripole magnet, comprising the steps of (a) providing a strip of magnetic material having first and second ends; and (b) laterally passing a magnet across and in close proximity to the strip of magnetic material, with the magnet having sufficient flux density to overcome the magnetic bias of the strip, and with the magnet being passed across said predetermined region of the strip, to thereby create a pole of one magnetic polarity in a predetermined region of the strip located between the ends of the strip, and having a pole of a different magnetic polarity than said one magnetic polarity at each end of the strip.

In still another aspect the present invention further provides a magnetic wand for use in laterally passing a magnet across the strip for converting the strip into a tripole bar magnet. The magnetic wand of the present invention includes a rod of nonferromagnetic material; a disc-shaped magnet disposed at one end of a rod, and having two opposed broad surfaces of opposite magnetic polarity, with one broad surface of the disc facing said one end of the rod; and a dome of ferromagnetic material disposed adjacent the other broad surface of the disc for aligning the flux density produced by the magnet over a large portion of the rounded surface of the dome.

Additional features of the present invention are described in relation to the description of the preferred embodiment.

BRIEF DESCRIPTION OF THE DRAWING

FIG. 1 is a plan view illustrating the orientation of active strips and a bias strip in a preferred embodiment of a presence-detection-system tag that includes a deactivatable frequency-dividing transponder.

FIG. 2 is a perspective view illustrating the method of the present invention for deactivating the tag of FIG. 1, and further illustrating additional features of the tag of FIG. 1 and a preferred embodiment of the magnetic wand of the present invention.

FIG. 2A is an exploded perspective view illustrating further detail of the magnetic wand of FIG. 2.

FIG. 3 is a diagram illustrating the magnetic fields created in the bias strip of the tag of FIGS. 1 and 2 by passage of the magnet included in the magnetic wand of FIGS. 2 and 2A during the forming of the tripole bar magnet of the present invention.

DESCRIPTION OF THE PREFERRED EMBODIMENTS

Referring to FIGS. 1 and 2, a preferred embodiment of a frequency-dividing transponder tag 10 of the type described in the aforementioned U.S. Pat. No. 4,727,360, is constructed so that its performance is not affected by interference with the Earth's magnetic field. The tag 10 includes two active strips 12, 14 of magnetic material that, when magnetically biased to be within a predetermined magnetic field intensity range, respond to excitation by electromagnetic radiation of a first predetermined frequency by radiating electromagnetic radiation of a second predetermined frequency that is a frequency-divided quotient of the first predetermined frequency.

Each active strip 12, 14 of magnetic material is a thin, flat ribbon of low coercivity magnetostrictive amorphous magnetic material having a transverse magnetic anisotropy defining the same magnetomechanical resonant frequency $f_1$, which is equal to one-half the first predetermined frequency in accordance with the dimensions of the ribbon, wherein when the ribbon is in the presence of a magnetic bias field within the predetermined magnetic field intensity range, the ribbon responds to the detection of electromagnetic radiation of a frequency $2f_1$ by transmitting electromagnetic radiation of the second predetermined frequency, which is a frequency-divided quotient of the frequency $2f_1$.

Both active strips 12, 14 are of the same magnetic material and of the same dimensions in order to define the same magnetomechanical resonant frequency $f_1$.

Suitable low coercivity magnetostrictive amorphous magnetic materials and the treatment and dimensioning thereof for making them useful as the active strips 12, 14 are described in the aforementioned U.S. Pat. No. 4,727,360.

The tag 10 further includes a bias strip 16 of magnetic material. The bias strip 16 is positioned in the same plane as the two active strips 12, 14 and is located between the two active strips 12, 14, with all three strips 12, 14, 16 being oriented in the same direction.

During the process of manufacturing the tag 10, the bias strip 16 is magnetized by passing it over a permanent magnet.

A suitable material for the bias strip 16 is 0.65 to 1.0 percent carbon steel ribbon with a coercivity of approximately 45 gauss and 2 to 5 mils thick.

The bias strip 16 of magnetic material is disposed in relation to the first and second active strips 12, 14 of magnetic material for biasing the first and second active strips 12, 14 so that at least one of the active strips 12, 14 is biased to be within the predetermined magnetic field intensity range when the bias strip 16 is magnetized, notwithstanding the orientation of the tag 10 with respect to the Earth's magnetic field.

The bias strip 16 is disposed at a distance $d_1$ from the first active strip 12 so that the first active strip 12 has an optimum magnetic bias field $B_1 - B_E$ resulting when the Earth's magnetic field $B_E$ is parallel with the length of the active strip 12 and opposing the magnetic field $B_1$ from the bias strip 16. The bias strip 16 is disposed at a distance $d_2$ from the second active strip 14 so that the second active strip 14 has an optimum magnetic bias field $B_2 + B_E$ resulting when the Earth's magnetic field $B_E$ is parallel with the length of the active strip 14 and aiding the magnetic field $B_2$ from the bias strip 16. This feature is described in greater detail in the aforementioned U.S. Pat. No. 4,727,360.

As seen in FIG. 2, the tag 10 includes a housing 18 defining cavities 20, 24 and 22 for containing the active strips 12, 14 and the bias strip 16 respectively. The housing 18 includes a paper cover 26, a paper base 28 and paper spacers 30. The active strips 12, 14 are disposed within the cavities 20, 24 so that they can vibrate freely within the cavities without interference or restriction, and so that no mechanical stresses are impressed upon the active strips by the walls of the cavities.

Referring to FIG. 2, the active strips 12, 14 of the tag 10 are deactivated by laterally passing the tag 10 with a magnet 32 in order to convert the bias strip 16 of magnetic material into a tripole bar magnet (FIG. 3), having a pole of one magnetic polarity S in a predetermined region 34 of the strip 16 located between the ends 36 of the strip, and having a pole of a different magnetic polarity N at each end 36 of the bias strip 16, to thereby provide opposing magnetic bias fields in opposite longitudinal halves of each active strip 12, 14 for causing any electromagnetic radiation of said second predetermined frequency $f_1$ that is generated in one half of each active strip 12, 14 to be of equal and opposite polarity and thus cancelled by any electromagnetic radiation of said second predetermined frequency $f_1$ that is generated in the other half of the respective active strip 12, 14. The magnet 32 must have sufficient flux density to overcome the magnetic bias of the bias strip 16.

The magnet 32 is laterally passed across and in close proximity to the bias strip 16 of magnetic material.

The magnet 32 is included in a magnetic wand 38, that further includes a rod 40 of insulating material and a dome 42 of ferromagnetic material. The magnet 32 is a disc-shaped magnet disposed at one end 44 of the rod 40. The disc-shaped magnet 32 has two opposed broad surfaces of opposite magnetic polarity, with one broad surface 46 of the disc facing the one end 44 of the rod 40. The magnet 32 is a neodymium-iron-boron magnet, having an energy density of approximately $25 \times 10^6$ gauss-oersteds, and a $\frac{3}{8}$ inch diameter.

The dome 42 of ferromagnetic material is disposed adjacent the other broad surface 48 of the disc-shaped magnet 32 for aligning the flux density produced by the magnet over a large portion of the rounded surface of the dome 42, so that the wand 38 can be inclined at an angle from perpendicular with respect to the tag 10 when passing the tag, while still enabling the magnetic field distributed from the magnet 32 to the tag 10 to be of sufficient strength to overcome the magnetic bias of the bias strip 16. The dome 42 has a degree of curvature that allows the angle of inclination with respect to perpendicular to be as much as approximately 30 degrees.

Preferably, the bias strip 16 is disposed at least coextensive with the active strips 12, 14. In any event, the tag 10 is passed by the magnet 32 in a predetermined region 34 of the bias strip 16 that is adjacent the longitudinal center of the active strip 12, 14.

A tripole magnet 16 (FIG. 3), per se, was formed by laterally passing the predetermined region 34 of the bias strip 16 of magnetic material having first and second ends 36 with the magnet 32 contained in the magnetic wand 38, as described above.

The above-described embodiments of the present invention are also useful for deactivating tags that include an active strip of material that generates predetermined harmonics of an interrogation signal, such as described in French Pat. No. 763,681 to Picard. A technique for deactivating such a tag is described in U.S. Pat. No. 3,747,086 to Peterson. Peterson describes disposing a bias strip of magnetic material in relation to the active strip in order to alter the generation of harmonics when the bias strip is magnetized. However, this technique is not always effective because, the magnetic field of the magnetized bias strip is sometimes overcome by ambient magnetic fields or by fields generated by equipment for detecting the harmonics.

I claim:

1. A method of deactivating a tag, said tag including a frequency-dividing transponder comprising (1) an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of said first predetermined frequency; and (2) a magnetized bias strip of magnetic material having first and second ends and disposed in relation to the active strip of magnetic material for magnetically biasing the active strip of magnetic material to be within said predetermined magnetic field intensity range only when the bias strip of magnetic material is magnetized, the method comprising the step of converting the bias strip of magnetic material into a tripole bar magnet, having a pole of one magnetic polarity in a predetermined region of the strip located between the ends of the strip, and having a pole of a different magnetic polarity than said one magnetic polarity at each end of the bias strip to thereby provide opposing magnetic bias fields in opposite longitudinal halves of the active strip for causing any electromagnetic radiation of said second predetermined frequency that is generated in one half of the active strip to be of equal and opposite polarity and thus cancelled by any electromagnetic radiation of said second predetermined frequency that is generated in the other half of the active strip.

2. A method according to claim 1, wherein said step is accomplished by laterally passing a magnet across and in close proximity to the bias strip of magnetic material, with the magnet having sufficient flux density to overcome the magnetic bias of the bias strip, and with the magnet being passed across said predetermined region of the bias strip.

3. A method according to claim 1, wherein said step is accomplished by laterally passing a magnet across and in close proximity to the bias strip of magnetic material, with the magnet having sufficient flux density to overcome the magnetic bias of the bias strip, and with the magnet being passed across said predetermined region of the bias strip; with said magnet being a disc disposed at one end of a rod, and having two opposed broad surfaces of opposite magnetic polarity; and with one broad surface of the disc facing said one end of the rod.

4. A method according to claim 1, wherein said step is accomplished by laterally passing a magnet across and in close proximity to the bias strip of magnetic material, with the magnet having sufficient flux density to overcome the magnetic bias of the bias strip, and with the magnet being passed across said predetermined region of the bias strip; with said magnet being a disc disposed at one end of a rod, and having two opposed broad surfaces of opposite magnetic polarity; with one broad surface of the disc facing said one end of the rod; and with a dome of ferromagnetic material being disposed adjacent the other broad surface of the disc for aligning the flux density produced by the magnet over a large portion of the rounded surface of the dome.

5. A method according to claim 1, wherein said step is accomplished by laterally passing a magnet across and in close proximity to the bias strip of magnetic material, with the magnet having sufficient flux density to overcome the magnetic bias of the bias strip, and with the magnet being passed across said predetermined region of the bias strip, and with said predetermined region of the bias strip being disposed adjacent the longitudinal center of the active strip.

6. A tag, comprising a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; and a tripole bar magnet, comprising a bar of magnetic material having a first end and a second end, the bar having a pole of one magnetic polarity in a predetermined region of the bar located between the ends of the bar, and having a pole of a different magnetic polarity than said one magnetic polarity at each end of the bar;

wherein the bar magnet is disposed in relation to the active strip of magnetic material for providing opposing magnetic bias fields in opposite longitudinal halves of the active strip for causing any electromagnetic radiation of said second predetermined frequency that is generated in one half of the active strip to be of equal and opposite polarity and thus cancelled by any electromagnetic radiation of said second predetermined frequency that is generated in the other half of the active strip.

7. A process of forming a tripole magnet, comprising the steps of (a) providing a strip of magnetic material having first and second ends; and (b) laterally passing a magnet across and in close proximity to the strip of magnetic material with the magnet having sufficient flux density to overcome the magnetic bias of the strip, and with the magnet being passed across said predetermined region of the strip, to thereby create a pole of one magnetic polarity in a predetermined region of the strip located between the ends of the strip, and having a pole of a different magnetic polarity than said one magnetic polarity at each end of the strip.

8. A process according to claim 7, wherein step (b) comprises passing the bias strip with a said magnet consisting of a disc disposed at one end of a rod, and having two opposed broad surfaces of opposite magnetic polarity; and with one broad surface of the disc facing said one end of the rod.

9. A process according to claim 7, wherein step (b) comprises passing the bias strip with a said magnet consisting of a disc disposed at one end of a rod, and having two opposed broad surfaces of opposite magnetic polarity; with one broad surface of the disc facing said one end of the rod; and with the other broad surface of the disc facing a dome of ferromagnetic material that aligns the flux density produced by the magnet over a large portion of the rounded surface of the dome.

10. A magnetic wand, comprising a rod of nonferromagnetic material;

a disc-shaped magnet disposed at one end of a rod, and having two opposed broad surfaces of opposite magnetic polarity, with one broad surface of the disc facing said one end of the rod;

and a dome of ferromagnetic material disposed adjacent the other broad surface of the disc for aligning the flux density produced by the magnet over a large portion of the rounded surface of the dome.

11. A magnetic wand according to claim 10, wherein the magnet is a neodymium iron boron magnet.

12. A method of deactivating a tag, said tag including (1) a harmonic-generating transponder including an active strip of material that, when magnetically biased to be within a magnetic field of a predetermined intensity, responds to excitation by electromagnetic radiation of a first predetermined frequency by radiating electromagnetic radiation of a second predetermined frequency that is a predetermined harmonic of the first predetermined frequency; and (2) a magnetized bias strip of magnetic material having first and second ends and disposed in relation to the active strip for magnetically biasing the active strip to be within a magnetic field different than said predetermined intensity when the bias strip of magnetic material is magnetized, the method comprising the step of converting the bias strip of magnetic material into a tripole bar magnet, having a pole of one magnetic polarity in a predetermined region of the bias strip located between the ends of the bias strip, and having a pole of a different magnetic polarity than said one magnetic polarity at each end of the bias strip to thereby provide opposing magnetic bias fields in opposite longitudinal halves of the active strip for causing any electromagnetic radiation of said second predetermined frequency that is generated in one half of the active strip to be of equal and opposite polarity and thus cancelled by any electromagnetic radiation of said second predetermined frequency that is generated in the other half of the active strip.

* * * * *

UNITED STATES PATENT AND TRADEMARK OFFICE

CERTIFICATE OF CORRECTION

PATENT NO. : 4,968,972

DATED : November 6, 1990

INVENTOR(S) : LARRY KEITH CANIPE

It is certified that error appears in the above-identified patent and that said Letters Patent is hereby corrected as shown below:

Column 2, the paragraph beginning at line 36 and ending at line 42 should be deleted.

Column 2, line 46, --and a predetermined region located between the ends of the strip-- should be inserted before "; and".

Column 2, line 52, "a" (second occurrence) should be changed to --said--.

Column 2,lines 53 and 54 "located between the ends of the strip" should be deleted.

Column 7,line 4, --and a predetermined region located between the ends of the strip-- should be inserted before "; and".

Signed and Sealed this

Nineteenth Day of May, 1992

*Attest:*

DOUGLAS B. COMER

*Attesting Officer*

*Acting Commissioner of Patents and Trademarks*